US006014110A

United States Patent [19]

Bridges

[11] Patent Number: 6,014,110

[45] Date of Patent: Jan. 11, 2000

[54] ANTENNA AND METHOD FOR RECEIVING OR TRANSMITTING RADIATION THROUGH A DIELECTRIC MATERIAL

[75] Inventor: William B. Bridges, Pasadena, Calif.

[73] Assignee: Hughes Electronics Corporation, El Segundo, Calif.

[21] Appl. No.: 08/840,180

[22] Filed: Apr. 11, 1997

[51] Int. Cl.[7] ..... H01Q 13/00; H01Q 1/00

[52] U.S. Cl. ..... 343/783; 343/784; 343/785; 343/786; 343/787

[58] Field of Search ..... 343/783, 784, 343/785, 786, 787

[56] References Cited

U.S. PATENT DOCUMENTS

| | | | |
|---|---|---|---|
| 1,730,412 | 10/1929 | Duncan, Jr. . | |
| 3,323,063 | 5/1967 | Walker et al. . | |
| 4,183,054 | 1/1980 | Patisaul et al. | 358/86 |
| 4,290,068 | 9/1981 | Bogner | 343/702 |
| 4,439,784 | 3/1984 | Furukawa et al. | 358/86 |
| 4,545,075 | 10/1985 | Miller et al. | 155/612 |
| 4,710,956 | 12/1987 | Rast | 380/20 |
| 4,747,160 | 5/1988 | Bossard | 455/33 |
| 4,809,011 | 2/1989 | Kunz | 343/787 |
| 5,073,930 | 12/1991 | Green et al. | 380/10 |
| 5,173,775 | 12/1992 | Walker | 358/141 |
| 5,214,501 | 5/1993 | Cavallerano | 358/12 |
| 5,272,525 | 12/1993 | Borchardt | 358/83 |
| 5,375,146 | 12/1994 | Chalmers | 375/103 |
| 5,394,559 | 2/1995 | Hemmie | 455/5.1 |
| 5,412,720 | 5/1995 | Hoarty | 380/15 |
| 5,483,663 | 1/1996 | Tawil | 455/3.2 |
| 5,574,964 | 11/1996 | Hamlin | 455/3.1 |
| 5,610,916 | 3/1997 | Kostreski et al. | 370/487 |
| 5,613,190 | 3/1997 | Hylton | 455/3.1 |
| 5,640,168 | 6/1997 | Heger et al. | 343/786 |

FOREIGN PATENT DOCUMENTS

| | | |
|---|---|---|
| 56-47183 | 4/1981 | Japan . |
| 63-257337 | 10/1988 | Japan . |
| 1-209825 | 8/1989 | Japan . |

OTHER PUBLICATIONS

Lenkurt Electric Co., Inc. The Lenkurt Demodulator: The CATV Video Microwave Link, vol. 20, No. 2, pp 2–7 (Feb., 1971).

European Telecommunication Standard, "Digital broadcasting systems for television, sound an ddata services; Satellite Master Antenna Television (SMATV) distribution systems," TM 1285 Revision 1, Draft pr ETS 300 473, Nov. 1994, Source: EBU/ETSI JTC, Reference: DE/JTC–DVB–7–1, European Telecommunications Standard Institute, European Broadcasting Union, France, pp. 3–25 (1994).

*Primary Examiner*—Robert H. Kim
*Assistant Examiner*—Roy M. Punnoose
*Attorney, Agent, or Firm*—V. D. Duraiswamy; M. W. Sales

[57] ABSTRACT

A low profile, receiving and/or transmitting antenna is adapted to be mounted onto an interior portion of a building or other structure to receive or transmit radiation through a first dielectric material, such as a window, associated with the building or other structure. The antenna includes a receiving/transmitting horn filled with a second dielectric material and a surface for mounting the antenna to the first dielectric material so that the horn is disposed at a particular angle with respect to a surface of the first dielectric material. A matching layer may be disposed between the first dielectric material and the second dielectric material to provide for a reflectionless match between the first and second dielectric materials.

21 Claims, 5 Drawing Sheets

ANTENNA AND METHOD FOR RECEIVING OR TRANSMITTING RADIATION THROUGH A DIELECTRIC MATERIAL

BACKGROUND OF THE INVENTION (a) Field of the Invention

The present invention relates generally to antennas and, more particularly, to antennas for receiving or transmitting radiation through a dielectric material.

(b) Description of Related Art

Satellites are commonly used to relay or communicate electronic signals, including audio, video, data, audio-visual, etc. signals, to or from any portion of a large geographical area, such as the continental United States. A satellite-based signal distribution system generally includes an earth station that modulates a carrier frequency with an audio/visual/data signal and then transmits (uplinks) the modulated signal to one or more, for example, geosynchronous satellites. The satellite(s) amplify the received signal, shift the signal to a different carrier frequency band and transmit (downlink) the frequency shifted signal to earth for reception at individual receiving units. Likewise, individual receiving units may transmit a signal, via a satellite, to the base station or to other receiving units.

Many satellite communication systems, including some commercial and military mobile communication systems as well as a direct-to-home satellite system developed by DIRECTV® (known commercially as DSS®), use millimeter wave (mmW) carrier frequencies, such as Ku band (ranging from approximately 12 GHz to 18 GHz) to transmit a signal from a satellite to one or more receiver units and/or vise-versa. Other known communication systems use a number of transmitters spaced throughout a geographical region to relay communications signals to and from individual receiver units within the regions.

Still other known communication systems operate in the mmW range above Ku-band and, in some instances, provide free-space point-to-point communication using the 60 GHz carrier frequency range where high signal losses occur. For example, it has been suggested to locate a parabolic dish antenna on an exterior portion of a building to receive a communication signal at, for example, Ku-band, and then to retransmit the communication signal at or near the 60 GHz carrier frequency band to receiving antennas associated with a number of receiving units within the building via transmitting antennas that overhang the roof of the building.

In all of these communication system configurations, it is desirable to use a Ku-band, a 60 GHz, or other receiving/transmitting antenna located on the interior of a building or a mobile unit to receive signals from or to transmit signals to a satellite antenna, a roof-mounted antenna or other antenna. Such an interior-mounted antenna eliminates the necessity of drilling holes in walls of the building, mounting further antennas on the exterior of a building or a mobile unit and/or running cable from each receiving unit to an exterior portion of a building or a mobile unit.

Due to space constraints, a receive/transmitting antenna mounted on the interior of a building or mobile unit should be small and relatively unobtrusive and, preferably, should be able to be mounted directly to, for example, a window to receive or transmit a communication signal through the window. The parabolic dish antennas associated with most communications systems satisfy neither of these criteria.

SUMMARY OF THE INVENTION

The present invention relates to a low profile receiving and/or transmitting antenna that can be mounted on the interior of a building or a mobile unit to receive and/or transmit radiation through a dielectric material associated with the building or the mobile unit. According to one aspect of the present invention, a receiving/transmitting horn is filled with a dielectric material and is placed adjacent to, for example, a window of a building or a mobile unit, to receive or transmit radiation through the window.

According to another aspect of the present invention, an antenna adapted to receive or transmit radiation through a first dielectric material includes a receiving/transmitting horn, a second dielectric material disposed within the horn and a surface for orienting a boresight of the antenna horn at a particular angle with respect to a normal to a surface of the first dielectric material when the antenna is disposed directly adjacent the surface of the first dielectric material. The index of refractions of the first and second dielectric materials may be the same or different. The antenna may also include a layer of a third dielectric material disposed between the horn and the first dielectric material, wherein the layer of the third dielectric material is rotatable with respect to the horn to enable the direction in which the horn is pointed to be easily changed.

In another embodiment, the antenna may include a matching layer made of a third dielectric material disposed adjacent the second dielectric material to provide for a reflectionless match with respect to radiation of a particular frequency traveling between the first dielectric material and the second dielectric material. The matching layer may be made of the same or different material as the first dielectric material.

According to another aspect of the present invention, a method of receiving or transmitting radiation through a first dielectric material comprises the steps of filling a receiving or a transmitting horn with a second dielectric material, placing the receiving or transmitting horn filled with the second dielectric material adjacent the first dielectric material and detecting radiation passing though the first dielectric material and into the horn or propagating radiation out of the horn through the first dielectric material.

DESCRIPTION OF THE PREFERRED EMBODIMENTS

Figure 1:
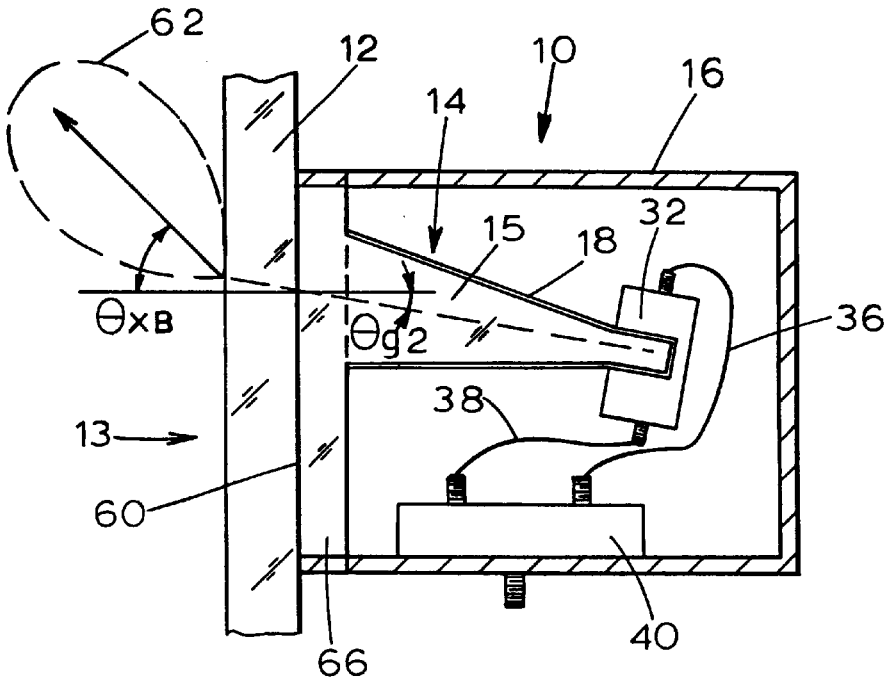
FIG. 1 is a cross-sectional side view of a first embodiment of the antenna according to the present invention.

By the way of example only, an antenna according to the present invention is described herein as constructed for use as a receive antenna for a mmw and, more specifically, a 60 GHZ communication signal. It should be understood, however, that the described antenna could also or alternatively be a transmitting antenna and that a receive and/or transmitting antenna could be constructed according to the principles disclosed herein for use with any desired satellite or ground-based, audio, video, data, audio-visual, etc. signal distribution system or communication system, including those which use wavelengths less than the mmW range, such as sub-millimeter wave and terra-wave communication systems, and wavelengths greater than the mmW range, such as microwave communication systems.

Referring now to FIGS. 1–4, a receive antenna 10 is attached to a first dielectric material 12, such as a window made of glass, and is configured to receive mmW radiation propagating along the exterior side 13 of the window 12 at, for example, 60 GHz. The mmW radiation may be transmitted by a satellite, a transmitter attached to the roof of the building in which the window 12 is located or any other transmitter at any desired location.

The antenna 10 includes a receiving/transmitting horn 14 filled with a second dielectric material 15 which may have the same or different index of refraction as the material of the window 12. The horn 14 and the material 15 are disposed within a cover 16 such that the horn 14 opens towards the window 12 and has a boresight which is offset from a normal to the window 12 by a boresight angle $\theta_{g2}$ which is, preferably, non-zero. The antenna 10 may be formed by filling a preformed metal horn with the dielectric material 15, by forming the dielectric material 15 in the shape of a horn and applying a metal coating 18 to the exterior surface thereof, or according to any other desired technique. As will be understood by one skilled in the art, the horn 14 may be shaped in any conventional manner such as circular, rectangular, square, etc. to receive or transmit signals through the window 12 at a particular wavelength, i.e, the tuning wavelength of the antenna 10.

The horn 14 illustrated in FIG. 1 includes a mixer board 32 mounted at a narrow end of the horn 14 away from the horn opening. The mixer board 32 may use any standard receiver or transmitter circuitry and is attached, via signal wires 36 and 38, to an electronics circuit board 40 which, in turn, is coupled to a demodulator (or signal transmitter). The board 40 may include an amplifier, a local oscillator and/or other necessary receive and/or transmit circuitry, as would be known in the art. In receiving mode, a local oscillator signal is sent to the mixer board 32 via the wire 36 to mix the received signal down to an intermediate frequency (IF) band between, for example, 950 MHz and 1450 MHz. The mixer board 32 provides this down-converted signal via the wire 38 to the circuit board 40 and, thereafter, to a demodulator (not shown) associated with, for example, an integrated receiver and detector (IRD) or a set-top box within the receiver unit. In transmitting mode, a signal at an IF frequency may be mixed with a carrier signal produced by a local oscillator and this mixed signal may be propagated out of the horn 14 through the window 12.

Figure 3:
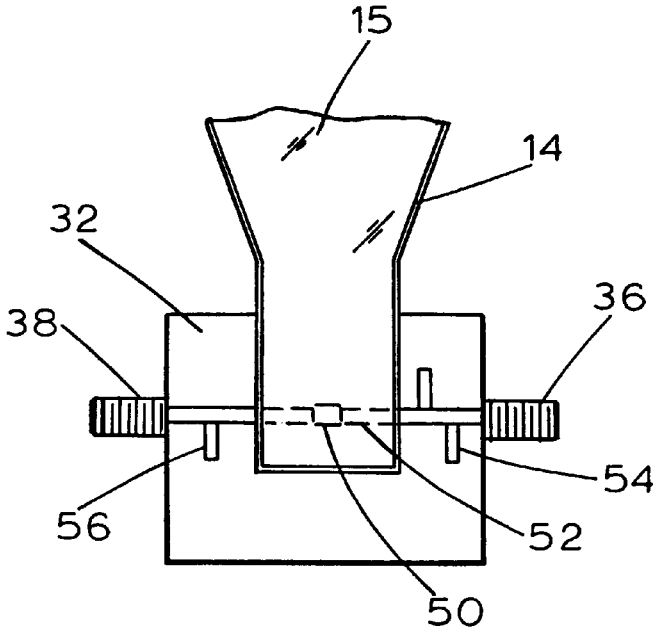
FIG. 3 is a cross-sectional side view of the mixer board mounting configuration of the antenna of FIG. 1.
Figure 4:
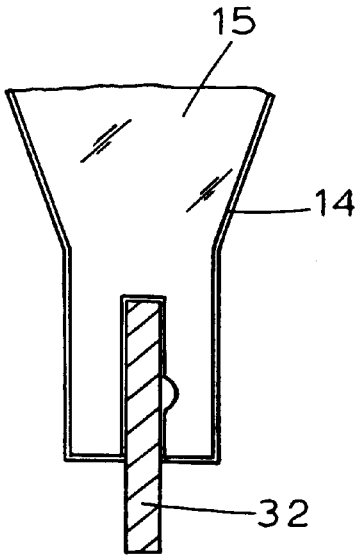
FIG. 4 is a cross-sectional top view of the mixer board mounting configuration of the antenna of FIG. 1.

As illustrated more clearly in FIGS. 3 and 4, the mixer board 32 is mounted in and extends through the narrow end of the horn 14 to receive and/or to transmit radiation. The mixer board 32 may include a mixer chip 50 disposed within a strip line 52 on the mixer board 32 to receive signals from the horn and from the local oscillator. The strip line 52 may include strip line matching networks 54 and 56 and/or any other desired matching networks to reduce receive and/or transmission losses. As illustrated in FIG. 4 the mixer board 32 may comprise a Duroid® board glued into a slot at the narrow end of the horn 14. If desired, the mixer board 32 may be large enough to include a local oscillator and/or any other desired electronics thereon.

In an alternative embodiment, the horn 14 may have one or more receive and/or transmit probe(s) mounted at the end thereof (instead of the mixer board 32) to receive and/or transmit radiation. In this configuration, the receive and/or transmit probe(s) would be attached to receiver and/or transmitter circuitry within the board 40 and could include matching capabilities as would be evident to those skilled in the art.

Referring again to FIG. 1, the antenna 10 has a surface 60 that is placed adjacent to and, preferably, is attached to a surface of the window 12 using any desired attachment technique. The surface 60 is molded or manufactured to conform with the surface of the window 12 across the entire horn opening to provide for a consistent interface between the window 12 and the antenna 10. If desired, the antenna 10 may be glued to the window 12 using any suitable type of glue and, preferably, using a low-loss glue such as epoxy, those commonly known as RTV or Q-Dope, etc.

Figure 2:
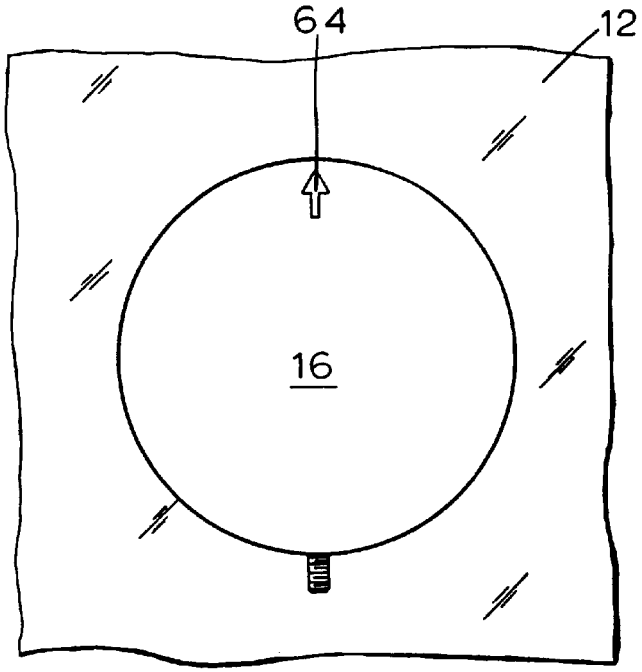
FIG. 2 is a rear view of the antenna of FIG. 1.

The antenna 10 is illustrated in FIGS. 1 and 2 as attached to the window 12 with the boresight of the horn 14 pointed to the upper-most position so that an external beam 62 (illustrated in FIG. 1) of the antenna 10 points to the most overhead elevational angle possible. In this manner, the antenna 10 is configured to best receive signals from a transmitter located directly above the window 12. However, the antenna 10 could be rotated to point the external beam 62 in other directions so as to better receive signals from transmitters positioned at other locations with respect to the window 12.

To enable a user to mount the antenna 10 properly, a marking such as an arrow 64 may be located on the back of the antenna casing 16 (as illustrated in FIG. 2) to indicate the direction in which the antenna horn 14 is pointed. The user can rotate the antenna 10 to point the arrow 64 and, thereby, the external antenna beam 62, towards the direction most closely aligned with a known transmitter (or receiver). The proper location of the antenna 10 may be determined before gluing the antenna 10 to the window 12, i.e., before the glue dries.

If desired, the antenna 10 may include a layer 66 (illustrated in FIG. 1) disposed between the horn 14 and the window 12 that is rotatable with respect to the horn 14. In such a configuration, the surface 60 of the layer 66 may be glued to the window 12 and, thereafter, the rest of the antenna 10 may be rotated with respect to the layer 66 to align the horn 14 with an external transmitter or receiver. The layer 66 may be releasably attachable to the rest of the antenna 10 in any known or desired manner so as to anchor the layer 66 to the horn 14 when the horn 14 has been properly aligned.

When attached to the window 12 as illustrated in FIGS. 1 and 2, the antenna 10 has an antenna beam internal to the dielectric material 15 (an internal antenna beam) pointing along the boresight angle $\theta_{g2}$ and an external antenna beam 62 pointing along an external boresight angle $\theta_{xB}$. Because of the difference in the indices of refraction associated with free space, the material of the window 12 and the dielectric material 15, the internal and external boresight angles $\theta_{g2}$ and $\theta_{xB}$ are different. Preferably, the antenna 10 is designed such that the external boresight angle $\theta_{xB}$ points in the direction of a signal source (in receive mode) or in the direction of a signal receiver (in transmission mode).

A method of configuring the antenna horn 14 to receive a signal from an external source (or to transmit to an external receiver) will now be described with reference to FIGS. 5 and 6 for the case in which the dielectric material 15 and the dielectric material of the window 12 are both chosen to be glass. To simplify the analysis, a ray-optics method is used to calculate angles approximately. A more accurate design, although much more time-consuming to carry out, could be obtained using an electromagnetic wave numerical computer solution with one of many commercially available software packages.

Generally speaking, the antenna 10 will be designed to receive signals expected to arrive at the window 12 at a maximum external glancing angle $\theta_{x1}$, measured with respect to a normal to the window 12. For such radiation to be collected by the horn 14, Snell's law specifies that the horn 14 can be pointed, at most, at a critical internal elevational boresight angle of $\theta_{gc}$ determined as:

$$\theta_{gc} = \sin^{-1}\left(\frac{n_x}{n_g}\sin\theta_{xl}\right) \tag{1}$$

wherein:

$\theta_{gc}$=critical internal boresight angle necessary to receive signals impinging on the window 12 at the external glancing angle $\theta_{x1}$;

$\theta_{x1}$=external glancing angle;

$n_x$=index of refraction of free space (equals 1); and $n_g$=index of refraction of the window 12 and the dielectric material 15.

If the external glancing angle $\theta_{x1}$ is chosen to be 90 degrees and, as noted above, the window 12 and the dielectric material 15 are made of glass, then equation (1) can be solved as:

$$\theta_{gc} = \sin^{-1}\left(\frac{n_x}{n_g}\sin 90\right) = \sin^{-1}\frac{1}{\sqrt{6}} = 24.1^\circ \tag{2}$$

wherein $n_g$ equals the square root of $\epsilon_r$, the relative permitivity of window glass. (Measured at 60 GHz, $\epsilon_r$ equals 6.) In this case, the antenna horn 14 must be pointed at an internal boresight angle $\theta_{gc}$ that is just slightly less than 24.1 degrees away from the normal to the window 12 to receive radiation impinging on the outside of the window 12 at an external glancing angle $\theta_{x1}$ equal to 90 degrees, i.e. coming from directly overhead. Preferably, most of the internal beam of the antenna 10 is at an angle less than the critical internal boresight angle $\theta_{gc}$, in this case 24.1 degrees. Of course the critical internal boresight angle $\theta_{gc}$ will be less if the external glancing angle $\theta_{x1}$ is chosen to be less than 90 degrees.

The elevational beamwidth and gain of the antenna 10 are dependent on the size of the horn 14 and the wavelength to which it is tuned. To determine elevational beamwidth and gain of the antenna 10, one can first determine the manner in which the radiation changes within the dielectric material 15 of the horn 14. In particular, the wavelength $\lambda$ of the radiation within the dielectric material 15 of the horn 14 is:

$$\lambda_g = \frac{n_x\lambda_x}{n_g} \tag{3}$$

wherein:

$\lambda_g$=wavelength of the received radiation within the dielectric material 15;

$\lambda_x$=wavelength of the received radiation in free space;

$n_x$=index of refraction of free space (equals 1); and $n_g$=index of refraction of the dielectric material 15.

Using equation (3), it can be seen that the wavelength $\lambda_g$ equals two millimeters (2 mm) when the free-space radiation is five millimeters (60 GHz) and the dielectric material 15 is glass (i.e., $n_g$ is approximately the square root of six). If the horn 14 of the antenna 10 has a diameter of 20 mm at the opening thereof and is designed to receive signals impinging on the window 12 at a free-space frequency of 60 GHz, the elevational beamwidth of the antenna beam internal to the dielectric material 15 can be approximated as:

$$\theta_{gEBW} = \frac{100^\circ}{D/\lambda_g} = \frac{100^\circ}{20\text{ mm}/2\text{ mm}} = 10^\circ \tag{4}$$

wherein:

$\theta_{gEBW}$=elevational beamwidth of the antenna beam internal to the dielectric material 15;

$\lambda_g$=wavelength of radiation in the dielectric material 15; and

D=diameter of the horn opening in the elevational direction.

Equation (4) is a well-known rule of thumb that can be used for aperture antennas. The value of 100 degrees used in equation (4) may actually range from about 70 degrees to about 100 degrees, depending on the exact field distribution in the horn, the flare angle, etc. as is well known and provided in numerous available antenna handbooks.

Figure 5:
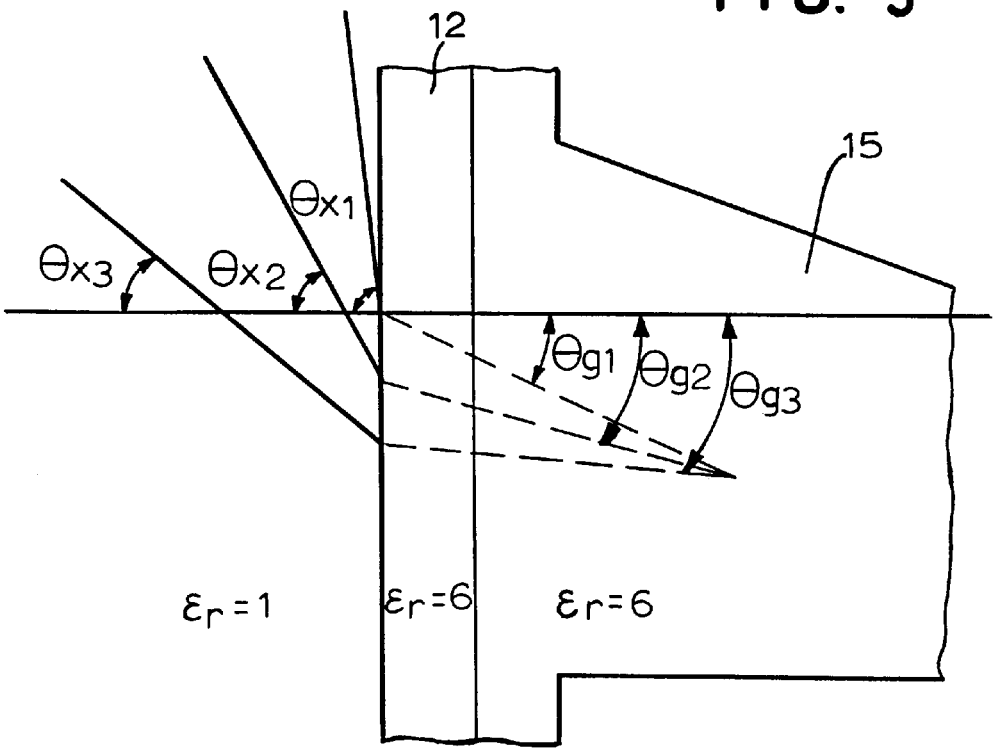
FIG. 5 is an expanded cross-sectional side view of a portion of the antenna of FIG. 1 illustrating the elevational antenna beam associated therewith.

Based on equation (4), the internal antenna beam will have an elevational beamwidth of plus and minus five degrees from the boresight of the horn 14, which enables one to set the internal beam angles illustrated in FIG. 5 as:

$\theta_{g1}=\theta_{gc}$=24.1 degrees (i.e., the critical internal boresight angle at which the antenna 10 will receive radiation at $\theta_{x1}$=90 degrees);

$\theta_{g2}=\theta_{gc}-5^\circ$=19.1 degrees (the internal boresight angle of the horn 14); and $\theta_{g3}=\theta_{gc}-10^\circ$=14.1 degrees.

Of course, the internal beamwidth of the antenna 10 can be narrowed if the diameter of the horn opening is made larger in the elevational direction and can be widened if the diameter of the horn opening is made smaller in the elevational direction. Furthermore, the internal boresight of the horn 14 may be located at other desired angles with respect to the normal to the window 12, as well as approximately 20 degrees (as illustrated above).

To determine how the beamwidth of the internal antenna beam translates into the external beam 62, the angles $\theta_{x1}$, $\theta_{x2}$ and $\theta_{x3}$ of FIG. 5 can be determined using Snell's law which provides that:

$$n_x\sin\theta_{xm}=n_g\sin\theta_{gm} \tag{5}$$

wherein:

$\theta_{xm}$=external angle $\theta_{xm}$ for m=1–3;

$\theta_{gm}$=internal angle $\theta_{gm}$ for m=1–3; and $n_g$=index of refraction of the dielectric material 15.

Using equation (5) and the values previously established for $\theta_{g1}$, $\theta_{g2}$ and $\theta_{g3}$:

$\theta_{x1}$=90 degrees (given);

$\theta_{x2}$=53 degrees (the external elevational boresight angle); and $\theta_{x3}$=36 degrees.

The external elevational beamwidth $\theta_{xEBW}$ is, therefore, approximately 90–36 or about 54 degrees. Of course, the external elevational beamwidth can be narrowed by narrowing the internal beamwidth and/or by choosing an external maximum glancing angle $\theta_{x1}$ to be less than 90 degrees.

Figure 6:
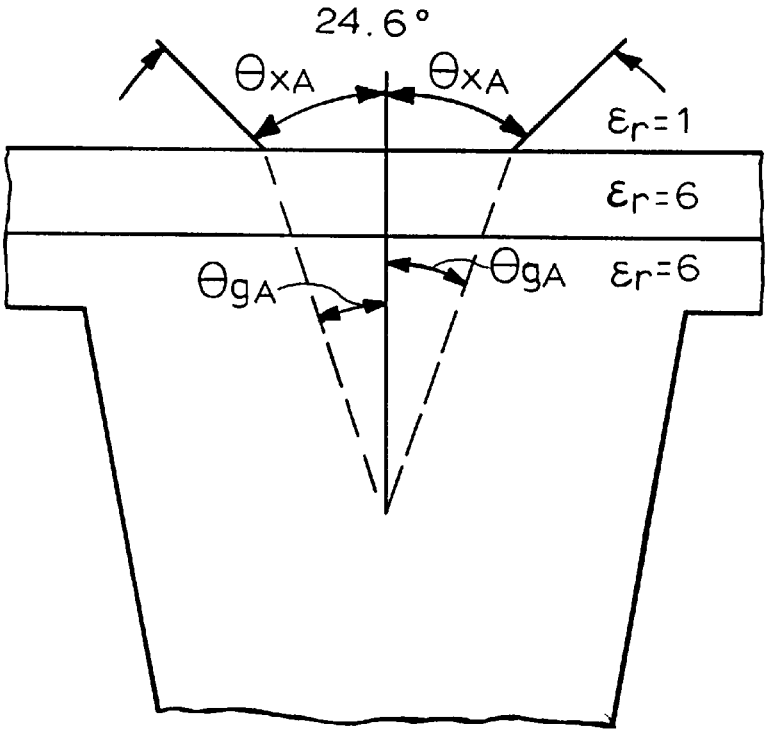
FIG. 6 is an expanded cross-sectional top view of a portion of the antenna of FIG. 1 illustrating the azimuth antenna beam associated therewith.

Referring to FIG. 6, the azimuth beamwidth of the antenna 10 can be similarly determined. Assuming that the azimuth diameter of the horn opening is 20 mm and that the horn 14 is tuned to receive 60 GHZ free-space radiation, equation (4) can be used to estimate that the internal azimuth beam angles $\theta_{gA}$ are offset from the boresight angle of zero degrees by plus and minus five degrees. Using Snell's law of equation (5), the external azimuth beam angles $\theta_{xA}$ (measured from the normal to the window 12) are about 12.3 degrees so that the external beam of the antenna 10 has an azimuth beamwidth $\theta_{xABW}$ of about 24.6 degrees.

The gain of the antenna 10 can be approximated as:

$$\text{GAIN} = \frac{4\pi}{\Omega} \tag{6}$$

wherein:

GAIN=antenna gain; and $\Omega$=the solid angle of the radiated beam.

As an approximation, the beam solid angle may be estimated as $\Omega=\theta_{xEBWE}\ \theta_{xABW}$. In the above-illustrated example, $\Omega$ is approximately 54 degrees by 24 degrees (approximately 0.39 steradians) so that the gain of the antenna is about 32 or 15 dB. Of course, making the horn aperture larger increases the gain of the antenna 10.

Although the antenna has been illustrated as having a dielectric material 15 comprising glass and being designed to receive free-space radiation at 60 GHz impinging on a window (made of glass) at maximum angle of 90 degrees, the horn 10 could, instead, include any other dielectric material, could be designed to receive (or transmit) radiation at other free-space wavelengths or arriving at (or exiting from) the window 12 at other maximum elevational and/or azimuth angles of incidence. Likewise, the antenna 10 could be designed in the manner indicated above to be used to receive or transmit radiation through dielectric materials other than window glass. Thus, one or both of the window 12 and the dielectric material 15 could be made of, for example, plastic, lucite, teflon, etc. While, preferably, the window 12 and the dielectric material 15 are made of the same material, this need not be the case. In fact, the dielectric material 15 may be any other low loss dielectric material including, for example, an artificial dielectric material such as the STYCAST® artificial dielectric material made by Emerson & Cummins, which can be manufactured to have any of a number of different dielectric constants. Furthermore, using the principles disclosed above, one skilled in the art could design a receiving and/or transmitting antenna to have other desired beamwidths, gains, etc. by changing the size of the horn opening, the internal boresight angle $\theta_{g2}$, the index of refraction of the dielectric material 15, etc.

Figure 7:
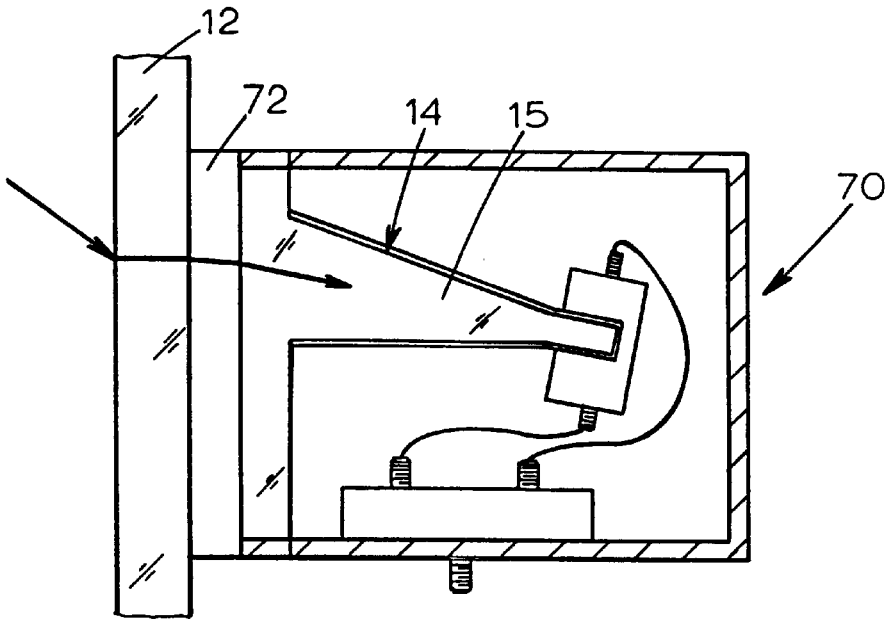
FIG. 7 is a cross-sectional side view of a second embodiment of the antenna according to the present invention.

Referring now to FIG. 7, a further embodiment of a receiving/transmitting antenna 10 according to the present invention is illustrated as including an intermediate layer of a third dielectric material, referred to hereinafter as a matching layer 72, disposed between the horn 14 and the window 12. Preferably, the matching layer 72 provides a reflectionless match between the window 12 and the horn 14 using, for example, a quarter-wave matching technique. The matching layer 72 is advantageously used when the dielectric material 15 of the horn 14 is different than the dielectric material of the window 12, for example, when dielectric material 15 of the horn 14 is chosen to have lower loss than the dielectric material of the window 12. In one embodiment, the dielectric material 15 may be chosen to be polystyrene, having a permitivity of 2.56 and an index of refraction equal to the square root of 2.56 (i.e., 1.6).

Figure 8:
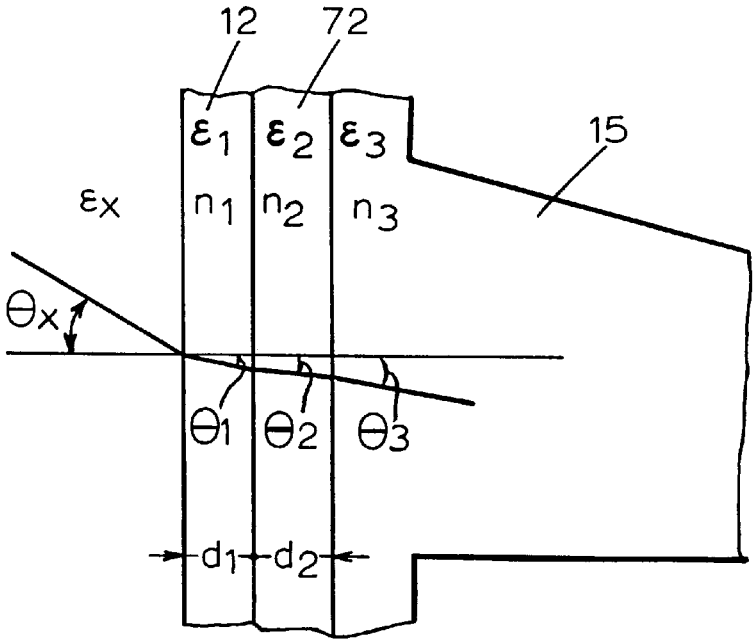
FIG. 8 is an expanded cross-sectional side view of the antenna of FIG. 7.

The index of refraction and the width of the matching layer 72 should be chosen to provide a proper effective quarter-wave (or odd integer multiple thereof) matching layer to the horn 14. Referring now to FIG. 8, the choice of the index of refraction ($n_2$) and the thickness ($d_2$) of the matching layer 72 is determined as a function of the wavelength of the received radiation and the indices of refraction of the window 12 ($n_1$) and the dielectric material 15 ($n_3$). FIG. 8 illustrates an incoming ray of radiation in free space ($n_x$=1), passing through a window 12 made of glass ($n_x=6^{1/2}$), passing through the matching layer 72 and passing into the dielectric material 15 comprising, in this example, polystyrene ($n_3$=1.6).

The plane of incidence for an electromagnetic wave incident on a surface is the plane defined by the normal to the surface and the direction of propagation of the wave. If the electric vector of the incident wave lies in this plane, the wave is said to be a TM (transverse magnetic) wave. If the magnetic field vector lies in this plane, the wave is said to be a TE (transverse electric) wave. If the wave is arbitrarily polarized, it can be expressed as the mixture (vector sum) of TE and TM components. A convenient tool for analyzing the propagation of electromagnetic waves through layered media is the so-called "wave-impedance" method, which reduces the electromagnetic propagation problem to that of a simple transmission line model.

As is generally known, the wave impedances for TE and TM waves for a particular dielectric material (i.e., the impedance in the direction normal to the surface of the dielectric material) are defined respectively as:

$$Z_{TE} = \frac{\eta}{\cos\theta} \tag{7}$$

$$Z_{TM} = \eta\cos\theta \tag{8}$$

wherein:

$Z_{TE}$=wave impedance for a TE wave in the direction normal to the surface of the dielectric material;

$Z_{TM}$=wave impedance for a TM wave in the direction normal to the surface of the dielectric material;

$\eta$=wave impedance in the direction of the propagation of the radiation through the dielectric material; and $\theta$=angle between the radiation path within the dielectric material and a normal to the dielectric material.

For a reflectionless match at the interface between the window 12 and the horn 14 of FIG. 8, the following well-known "quarter-wave line" matching conditions must be satisfied:

$$Z_2=\sqrt{Z_1 Z_3} \tag{9}$$

wherein:

$Z_1$=wave impedance within the first dielectric material (the glass of window 12);

$Z_2$=wave impedance within the second dielectric material (the matching layer 72); and $Z_3$=wave impedance within the third dielectric material (the horn material 15); and $$\frac{d_2}{\cos\theta_2} = \frac{\lambda_x}{4}\sqrt{\frac{\epsilon_x}{\epsilon_2}} \tag{10}$$

wherein:

$d_2$=thickness of the second layer, i.e., the matching layer 72;

$\epsilon_x$=permitivity of free space;

$\epsilon_2$=permitivity of the second layer (the matching layer 72);

$\theta_2$=angle between the path of the radiation within the second layer (the matching layer 72) and the normal thereto; which is a function of $\theta_x$ (the angle between the radiation in free space and the normal to the matching layer); and $\lambda_x$=wavelength of the radiation in free space.

Solving equation (10) for the thickness $d_2$ gives:

$$d_2 = \frac{c}{f}\frac{n_x}{4n_2}\cos\theta_2 \tag{11}$$

wherein:

c=speed of light in free space;

f=frequency of the radiation;

$n_x$=index of refraction of free space (equals 1); and $n_2$=index of refraction of the second layer (the matching layer 72).

Essentially, equations (10) and (11) determine an effective quarter-wavelength thickness of the dielectric material in the direction normal to the surface of the material which accounts for the change of the wavelength of the radiation within the material and the direction that the radiation is traveling through the material.

Given $\theta_x$, f, $n_1$ and $n_3$, one needs only to solve equations (9) and (11) for $n_2$ and $d_2$ to determine the characteristics of a suitable quarter-wave matching layer 72. Of course, the solution depends on the polarization (TE wave or TM wave) of the incoming (or outgoing) radiation because the wave impedance is different for each of these cases.

Solving for the TM wave case can be accomplished using the TM wave impedance definition of equation (8) expressed as:

$$Z_m = \eta_m\cos\theta_m = \frac{\eta_x}{n_m}\cos\theta_m \tag{12}$$

wherein:

$\eta_x$=x wave impedance of the radiation in free space at the angle $\theta_m$;

$\eta_m$=wave impedance of the radiation in the mth layer of dielectric material at the angle $\theta_m$;

$n_m$=index of refraction of the mth layer; and $\theta_m$=the angle of propagation of the radiation through the mth layer with respect to the normal thereto.

Substituting the expressions for $Z_1$, $Z_2$, and $Z_3$ as defined by equation (12) into equation (9) provides that:

$$Z_2 = \frac{\eta_x}{n_2}\cos\theta_2 = \frac{\eta_x}{\sqrt{n_1 n_3}}\sqrt{(\cos\theta_1\cos\theta_3)} \tag{13}$$

Solving equation (13) for $n_2$ gives:

$$n_2 = \eta_x\cos\frac{\theta_2}{Z_2} = \sqrt{n_1 n_3}\cos\frac{\theta_2}{\sqrt{\cos\theta_1\cos\theta_3)}} \tag{14}$$

As is generally known, the angles $\theta_1$, $\theta_2$ and $\theta_3$ can be expressed in terms of $\theta_x$ as:

$$\cos\theta_m = \sqrt{1-\sin^2\theta_m} = \sqrt{1-\left(\frac{n_x}{n_m}\right)^2\sin^2\theta_x} \tag{15}$$

Substituting the expressions for $\cos\theta_1$, $\cos\theta_2$, and $\cos\theta_3$ defined by equation (15) into equation (14) produces the equation for $n_2$ as follows:

$$n_2 = \frac{\sqrt{n_1 n_3}\sqrt{1-\left(\frac{n_x}{n_2}\right)^2\sin^2\theta_x}}{\sqrt[4]{\left(1-\left(\frac{n_x}{n_1}\right)^2\sin^2\theta_x\right)\left(1-\left(\frac{n_x}{n_3}\right)^2\sin^2\theta_x\right)}} \tag{16}$$

Equation (16) can be solved using a root solving technique, such as that provided by Mathcad, or using any other standard computer or algebraic technique. Once $n_2$ has been determined, equation (11) can be solved for $d_2$ to completely specify the matching layer 72 for any desired free-space angle of incidence $\theta_x$. For the case in which the window 12 is made of glass, the dielectric material 15 is made of polystyrene and the horn 14 is tuned to receive free-space radiation at 60 GHz, the charts of FIGS. 9A and 9B can be used to determine the corresponding sets of $n_2$ and $d_2$ for every angle $\theta_x$ between 0 degrees and 90 degrees. For example, from FIGS. 9A and 9B it can be seen that, for a glancing angle of incidence $\theta_x$ of approximately 70 degrees, the index of refraction $n_2$ of the matching layer 72 should be approximately 2.03 (FIG. 9A) while the thickness $d_2$ of that layer should be about 0.545 mm (FIG. 9B). Of course, as would be known, the thickness $d_2$ can be any odd integer multiple of the effective quarter-wavelength of the received radiation.

Figure 9A:
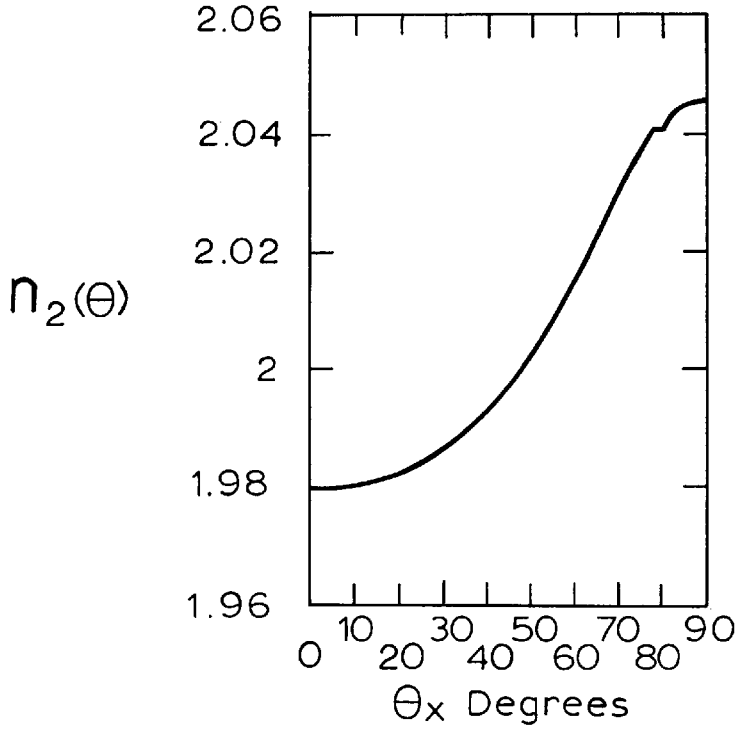
FIGS. 9A and 9B are charts defining corresponding sets of values for the index of refraction and the thickness of a matching layer of the antenna of FIG. 7.
Figure 9B:
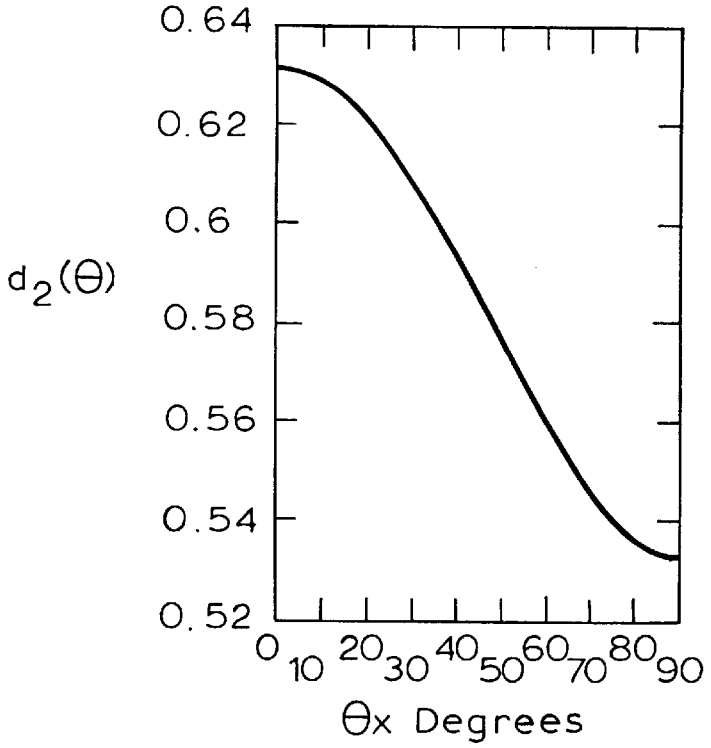

Although the charts of FIGS. 9A and 9B illustrate the relationship between $n_2$ and $d_2$ for the case of a glass window and a horn 14 filled with polystyrene, equations (11) and (16) can be used to solve for the index of refraction and the width of a matching layer when other materials are used for the window 12 and/or the dielectric material 15, for any free-space angle of incidence $\theta_x$ for TM incident waves. As would be evident to one skilled in the art, an equation corresponding to equation (16) can also be determined for TE incident waves.

In a further embodiment, the antennas 10 and/or 70 can include two mixer boards mounted at right angles with respect to one another to detect both polarizations (TE waves and TM waves) simultaneously. However, the transmission loss at the surface of the window 12 will be different for the TE and TM waves and, most likely, no single matching layer 72 will produce a reflectionless match at both polarizations. None-the-less, a matching layer 72 could be designed for both waves which would improve the reception of both waves over the case in which no matching layer 72 is provided. While, preferably, the dielectric material 15 has a dielectric constant that is less than that of the window 12, the dielectric constant of the material 15 may, instead, be greater than that of the window 12 and/or the matching layer 72. Also, if desired, the horn dielectric material 15 may be made of the same material as the window 12 so that the TM and TE waves differ only in the first surface losses. Thus, as will be understood by those skilled in the art, the dielectric material 15 and/or the matching layer 72 may comprise materials other than window glass and polystyrene including, for example, other types of glass; low loss polymers such as plastic, teflon, rubber, etc.; ceramics, such as aluminum oxide and berillium oxide; artificial dielectrics such as the STYCAST® artificial dielectric; etc.

In a still further embodiment, the matching layer 72 can be made of the same material as the window 12, e.g., glass. In this case, the window 12 is conceptually used as a part of an effective quarter-wave (or other) matching layer to provide a reflectionless match between the exterior region (e.g., region 13 of FIG. 1) and the dielectric material 15. Here, the matching layer 72 operates as a shim of appropriate thickness to make the material of the window 12 and the shim together have a summed thickness which is equal to an odd integer multiple of an effective quarter-wavelength of the radiation to which the horn 14 is tuned. If the window and matching layer 72 are glass and the horn 14 is designed to receive 60 GHz free-space radiation, then the appropriate index of refraction of the dielectric material 15 is about 36.

If desired, more than one matching layer could be provided between the horn 14 and the window 12. One or more matching layers could instead, or in addition, be placed on the outside of the window 12 opposite the horn 14 to provide appropriate matching. As noted above, the antennas 10 and 70 have been described herein as receive antennas. However, the same antennas could also be used as transmitting antennas if the mixing board(s) 32 are designed to propagate radiation out of the horn 14 at a selected frequency.

While the present invention has been described with reference to specific examples, which are intended to be illustrative only, and not to be limiting of the invention, it will be apparent to those of ordinary skill in the art that changes, additions and/or deletions may be made to the disclosed embodiments without departing from the spirit and scope of the invention.

What is claimed is:

1. An antenna adapted to receive or transmit radiation through a first dielectric material having an associated first index of refraction, the antenna comprising:

a receiving/transmitting horn;

a second dielectric material having an associated second index of refraction disposed within the horn; and an orienting device coupled to the second dielectric material that orients a boresight of the horn at a non-zero angle with respect to a normal to a surface of the first dielectric material when the antenna is disposed directly adjacent the surface of the first dielectric material.

2. The antenna of claim 1, wherein the first and second index of refractions are approximately equal.

3. The antenna of claim 1, wherein the second dielectric material comprises glass.

4. The antenna of claim 1, wherein the orienting device comprises a surface of the second dielectric material that is manufactured to conform with the surface of the first dielectric material.

5. The antenna of claim 1, wherein the orienting device includes a layer of a third dielectric material disposed between the horn and the first dielectric material when the antenna is disposed adjacent the first dielectric material, wherein the layer of the third dielectric material has a surface that conforms with the surface of the first dielectric material and the layer of the third dielectric material is rotatable with respect to the horn.

6. The antenna of claim 5, wherein the third dielectric material has an associated third index of refraction that is different than the second index of the refraction.

7. The antenna of claim 1, further including a matching layer made of a third dielectric material disposed between the second dielectric material and the first dielectric material when the antenna is disposed adjacent the first dielectric material, wherein the third dielectric material has an associated third index of refraction that is different than the second index of refraction.

8. The antenna of claim 7, wherein the antenna is tuned to radiation at a particular frequency and wherein the third index of refraction and a thickness of the matching layer are configured to provide a reflectionless match with respect to radiation of the particular frequency traveling between the first dielectric material and the second dielectric material.

9. The antenna of claim 8, wherein the third index of refraction is approximately equal to the first index of refraction and wherein the thickness of the matching layer is such that the sum of the thickness of the first dielectric material and the thickness of the matching layer is an odd integer multiple of an effective one-quarter wavelength of the particular frequency within the third dielectric material.

10. The antenna of claim 7, wherein the second material comprises polystyrene.

11. The antenna of claim 11, wherein the horn is a receiving horn and the surface of the first dielectric material comprises a first surface of the first dielectric material, wherein the first dielectric material has a second surface which is on a directly opposite side of the first dielectric material from the first surface of the first dielectric material and wherein the non-zero angle is chosen so that the horn receives radiation impinging on the second surface of the first dielectric material at a maximum angle of about 90 degrees with respect to a normal to the second surface of the first dielectric material.

12. The antenna of claim 1, wherein the non-zero angle is approximately 20 degrees and wherein the horn has a beamwidth within the second dielectric material of approximately 10 degrees in at least one direction.

13. The antenna of claim 1, wherein the horn is configured to receive or transmit free-space radiation at approximately 60 GHz.

14. The antenna of claim 1, wherein the receiving/transmitting horn includes a mixer board mounted directly onto an end thereof.

15. A method of receiving radiation through a first dielectric material having an associated first index of refraction comprising the steps of:

filling a receiving horn with a second dielectric material having an associated second index of refraction;

placing the receiving horn and the second dielectric material adjacent the first dielectric material so that a boresight of the receiving horn is disposed at a non-zero angle with respect to a normal to the surface of the first dielectric material against which the horn is placed; and detecting radiation passing through the first dielectric material and into the receiving horn.

16. The method of receiving radiation through a first dielectric material according to claim 15, including the step of choosing the second dielectric material so that the second index of refraction is approximately equal to the first index of refraction.

17. The method of receiving radiation through a first dielectric material according to claim 15, further including the step of disposing a matching layer made of a third dielectric material having an associated third index of refraction that is different than the second index of refraction between the receiving horn and the first dielectric material before the step of detecting.

18. The method of receiving radiation through a first dielectric material according to claim 17, further including the step of selecting the third index of refraction and the thickness of the matching layer to produce a reflectionless match with respect to radiation traveling between the first dielectric material and the second dielectric material.

19. The method of receiving radiation through a first dielectric material according to claim 15, further including the step of rotating the receiving horn to align the receiving horn with the direction of incoming radiation after the step of placing the receiving horn and the second dielectric material adjacent the first dielectric material.

20. A method of transmitting radiation through a first dielectric material having an associated first index of refraction comprising the steps of:

filling a transmitting horn with a second dielectric material having an associated second index of refraction;

placing the transmitting horn and the second dielectric material adjacent the first dielectric material so that a boresight of the transmitting horn is disposed at a non-zero angle with respect to a normal to the surface of the first dielectric material against which the horn is placed; and propagating radiation out of the transmitting horn through the first dielectric material.

21. The method of transmitting radiation through a first dielectric material according to claim 20, further including the step of disposing a matching layer made of a third dielectric material having an associated third index of refraction that is different than the second index of refraction between the first dielectric material and the transmitting horn before the step of propagating.

* * * * *